US006484931B1

(12) United States Patent
Höfte

(10) Patent No.: US 6,484,931 B1
(45) Date of Patent: Nov. 26, 2002

(54) SIFT-RESISTANT CARTONS HAVING SLOTTED CLOSURE STRUCTURES

(75) Inventor: Paulus Antonius Augustinus Höfte, St-Martens Latem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/262,558

(22) Filed: Mar. 4, 1999

(51) Int. Cl.[7] ..... B65D 5/68

(52) U.S. Cl. ..... 229/149; 229/125.16; 229/145

(58) Field of Search ..... 229/125.16, 145, 229/149; 220/345.6, 378, 795, 803, 806, 849

(56) References Cited

U.S. PATENT DOCUMENTS

| | | | | | |
|---|---|---|---|---|---|
| 2,123,501 | A | * | 7/1938 | Cumminghame | 229/125.16 |
| 2,430,610 | A | * | 11/1947 | Guyer | 229/149 |
| 2,511,523 | A | * | 6/1950 | Abrams | 229/149 |
| 2,531,507 | A | * | 11/1950 | Goodyear | 229/149 |
| 2,550,493 | A | * | 4/1951 | Ohison | 220/849 |
| 2,794,588 | A | * | 6/1957 | George et al. | 229/125.16 |
| 2,957,617 | A | * | 10/1960 | Bolding | 229/145 |
| 3,357,631 | A | * | 12/1967 | Aid et al. | 229/149 |
| 3,949,931 | A | | 4/1976 | Hall | |
| 4,099,665 | A | * | 7/1978 | Bergstein | 229/149 |
| 4,771,936 | A | * | 9/1988 | Dolby | 229/125.16 |
| 5,024,709 | A | * | 6/1991 | Faulkner, III et al. | 493/128 |
| 5,511,722 | A | * | 4/1996 | Dixon | 229/149 |
| 5,520,302 | A | * | 5/1996 | Anderson et al. | 220/803 |
| 5,711,476 | A | | 1/1998 | Fujimoto et al. | |
| 5,875,960 | A | | 3/1999 | Nanno | |

FOREIGN PATENT DOCUMENTS

| | | | | |
|---|---|---|---|---|
| DE | 79 35 898 | | 4/1980 | |
| FR | 1558508 | | 2/1969 | |
| WO | 93/01095 | * | 1/1993 | 229/149 |

* cited by examiner

*Primary Examiner*—Gary E. Elkins
(74) *Attorney, Agent, or Firm*—Thibault Fayette; Kim William Zerby; Steven W. Miller

(57) ABSTRACT

A sift-resistant recloseable package is provided which includes a container for storing a product and a lid attached to the container for closing the container. The container includes a first panel having at least one slot disposed therethrough and a cover which extends over the slot for preventing the sifting of the product through the slot. The cover is attached to the first panel. The lid has a downwardly depending flap with an extension attached thereto, wherein the extension engages the slot when the lid is in the closed position.

9 Claims, 8 Drawing Sheets

SIFT-RESISTANT CARTONS HAVING SLOTTED CLOSURE STRUCTURES

TECHNICAL FIELD OF THE INVENTION

The present invention relates to carton board packages, and, more particularly, to such packages suitable for housing granular, powdered or other materials and which are reclosable and sift-resistant.

BACKGROUND OF THE INVENTION

Reclosable cartonboard cartons for storing granular materials, such as powdered laundry detergents, have been available for many years. These cartons are typically formed from a cardboard which is laminated or coated with a moisture barrier material, such as polyethylene, polypropolyene, varnish or other barrier materials known in the art. Because the cardboard has a natural springback, the lids of these cartons tend to open thereby leading to contamination of the product and/or absorption of moisture by the product, both of which are undesirable. As such, the ability to repeatedly open and close/lock these cartons has long been a desirable property.

Some closure/locking systems have included various flap and tab interlocking arrangements in combination with perforation line, a known carton arrangement being illustrated as package 10 of FIGS. 1 and 2. Perforations 12 are broken by a user of the package 10 during the first opening, wherein the perforations 12 are typically disposed between the locking flap 14 and the tab 16. These closure arrangements generally require highly accurate folding and gluing steps during manufacture to achieve proper alignment between the locking flap 14 and the tab 16 and can cause difficulty to open the lid for the first time when the perforation are too hard to break. Further, during manufacturing and distribution, shifting of the product within the carton can cause buildup 18 (FIG. 2) of the product on the edge of the locking flap 14 resulting in spillage of the product 19 upon opening of the lid. When a carton is knocked, over (especially large capacity cartons), the lid is also prone to opening after the perforations have been broken.

Accordingly, there exists a need to provide a carton having locking and sealing features which eliminate the need for perforations, thereby simplifying use of the lid. Further, there exists a need to provide a carton which is easier to manufacture and which does not require highly precise folding and gluing steps during manufacture. Still further, there exists a need to provide a carton having improved closure arrangements which can prevent powder spillage upon the first opening and which better resist opening of the lid when a carton is knocked over. Yet further there exists a need to provide a carton which can accommodate multiple closure arrangements for improved resistance to accidental opening of the lid.

SUMMARY OF THE INVENTION

A sift-resistant recloseable package is provided which includes a container for storing a product and a lid attached to the container for closing the container. The container includes a first panel having at least one slot disposed therethrough and a cover which extends over the slot for preventing the sifting of the product through the slot. The cover is attached to the first panel. The lid has a downwardly depending flap with an extension attached thereto, wherein the extension engages the slot when the lid is in the closed position.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Figure 1:
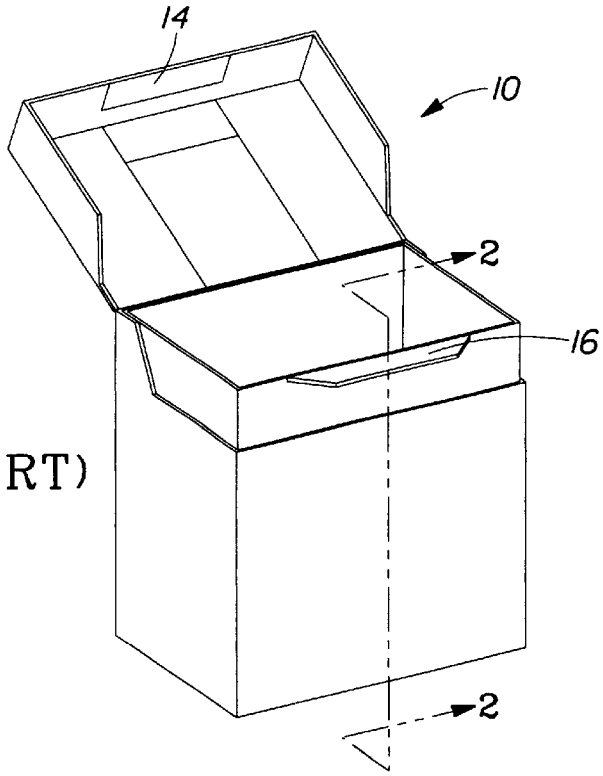
Fig. 1 (PRIOR ART)
FIG. 1 is a perspective view of a prior art package, wherein the lid is raised and the perforations between the tab and flap have be separated.
Figure 2:
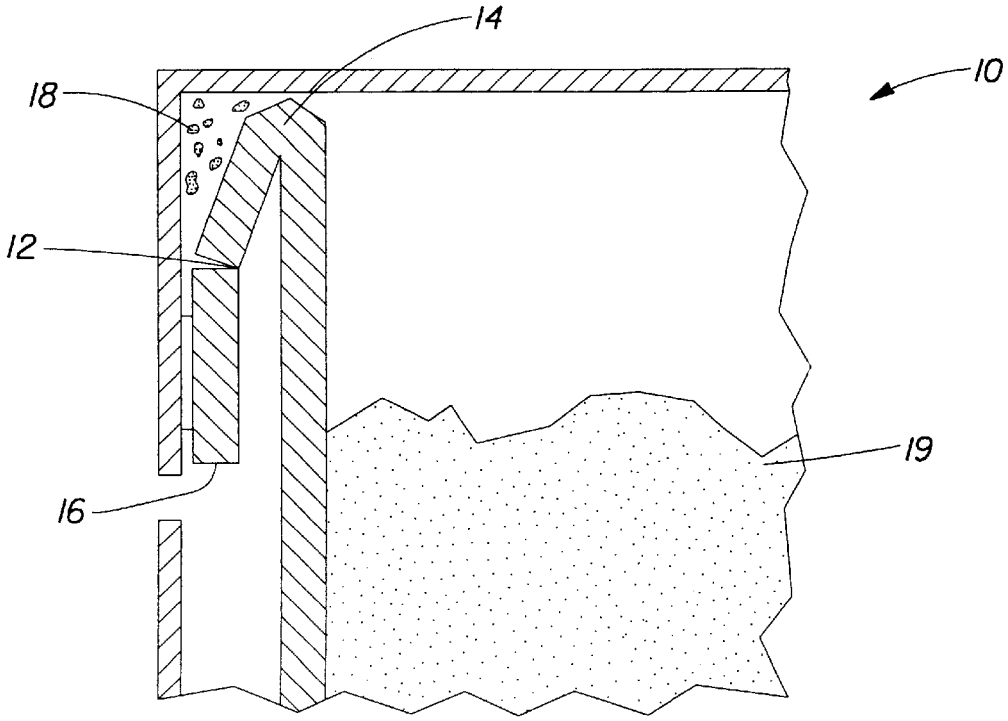
Fig. 2 (PRIOR ART)
FIG. 2 is an enlarged partial cross sectional view of the prior art package of FIG. 1 when the lid is in the closed position and prior to fracture of the perforations, wherein a buildup of product is illustrated.
Figure 3:
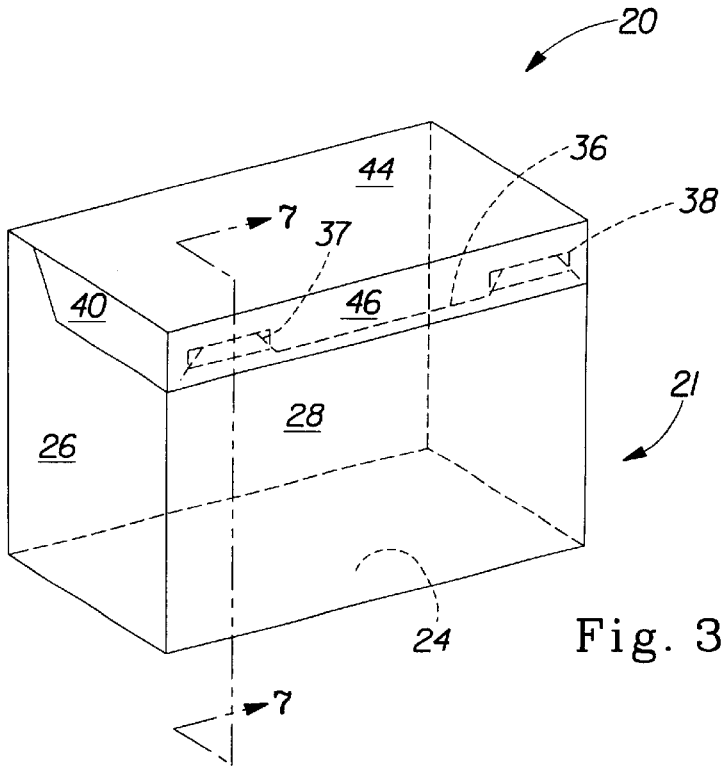
FIG. 3 is a perspective view of a preferred package made in accordance with the present invention, prior to opening.

Reference will now be made in detail to the present preferred embodiments of the invention, examples of which are illustrated in the accompanying drawings wherein like numerals indicate the same elements throughout the views and wherein reference numerals having the same last two digits (e.g., 20 and 120) connote similar elements. As discussed more fully hereafter, the present invention is directed to a reclosable and sift-resistant package. As used herein the phrase "sift resistant" is intended to refer to a package which prevents unwanted escape of its product, for example in the form of dust or particles. A particularly preferred carton or package 20 made in accordance with the present invention is illustrated in FIG. 3. The package 20 is illustrated as a six-sided carton having a lid 22 interconnected with a container 21 formed from a base 24 and side panels 26, 28, 30 and 32 (30 and 32 being best seen in FIG.

4). The lid, base and side panels each have inner and outer surfaces, wherein the inner surfaces are disposed within the interior of the package 20 and the exterior surfaces are disposed about the exterior of the package (the exterior surfaces only being visible in FIG. 3).

The package 20 is preferably used to store powdered or granular products 34 (FIG. 4), examples of which might include laundry detergents, foods, and the like. In addition, the package 20 can be used to store any other products where it is desired to provide a freshness seal and/or prevent exposure of the product to the air or moisture. The terms "granular" and "powdered" are used interchangeably herein and are intended to refer to any products comprising solid or semi-sold particles. While the present invention is described herein with reference to the exemplary six-sided package of FIG. 3, it is contemplated that the present invention can be adapted for use with other package configurations and shapes. For example, the present invention can be used with packages having one or more curved or curvilinear panels and the like. Further, the present invention can be used with top fill and side fill cartons. While the package 20 is illustrated in FIG. 3 with the lid 22 disposed at the top of the carton, it is contemplated that the lid 22 can be placed at other locations, multiple lids can be provided and other lid configurations can be accommodated.

Figure 4:
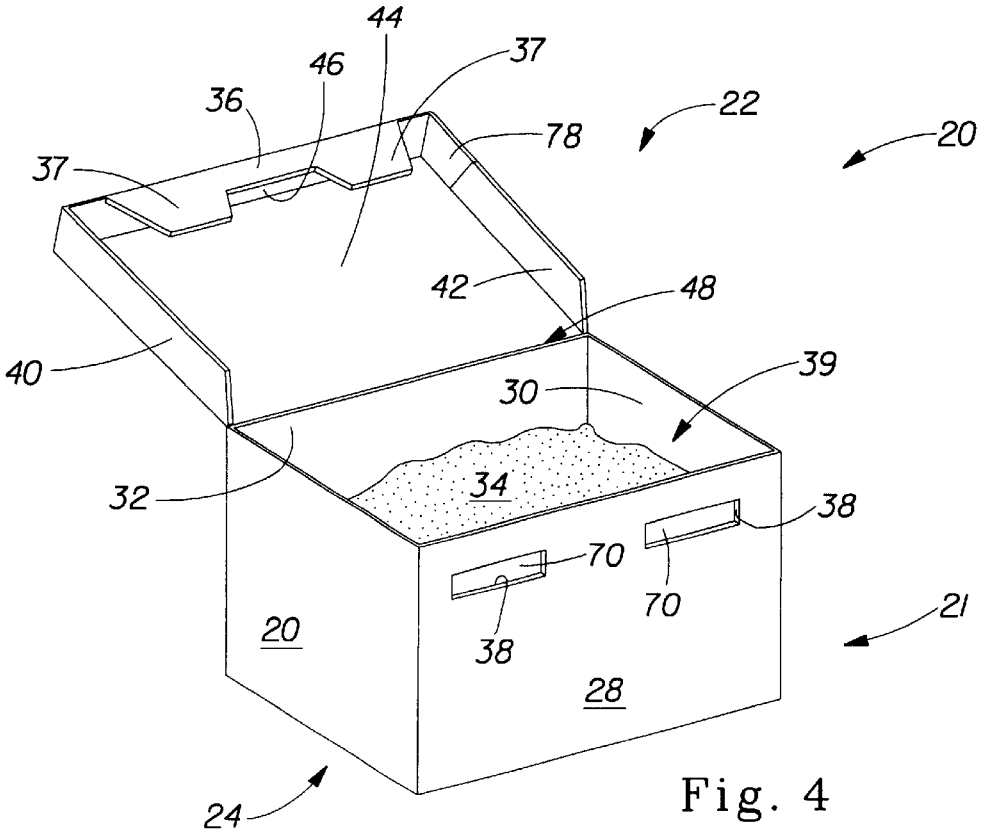
FIG. 4 is a perspective view of the package of FIG. 1, in an open position with the lid raised.
Figure 7:
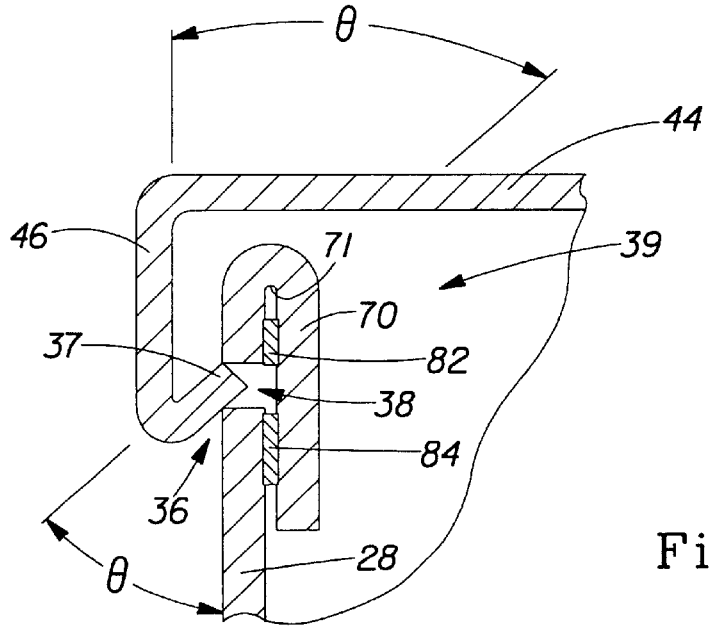
FIG. 7 is an enlarged partial cross-sectional side view of the package of FIG. 3, taken along line 7—7 thereof.

In accordance with one aspect of the present invention, the lid 22 includes a tab 36 (FIG. 4) having one or more extensions 37. The extensions 37 engage one or more slots 38 when the lid is in the closed position, as best seen in FIGS. 3 and 7. The lid 22 includes side lid flaps 40 and 42, a top lid flap 44 and a front lid flap 46 to which is connected the tab 36. The tab 36 preferably extends substantially the length of the front lid flap 46, thereby adding additional rigidity to the lid 22 which can prevent accidental tearing of the same. Each extension 37 preferably tapers toward its distal end, as best seen in FIG. 4, to facilitate engagement of the distal end with its mating slot 38. The lid 22 is connected to the side panel 32 by a hinge 48 which is disposed between the top lid flap 44 of the lid 22 and the side panel 32. As will be appreciated, the hinge 48 can be integrally formed with the lid 22 and side panel 32 or can be provided as a separate structure, as is known in the art. As will be appreciated, the side and front lid flaps 40, 42 and 46 will overlap with the side panels 26, 28 and 30, respectively, when the lid 22 is in the closed position.

As best seen in FIG. 4, the container 21 comprises an opening 39 through which the product 34 can be removed when the lid is in the raised position. A seal, such as that described in the commonly assigned U.S. patent application entitled "Cartons Having A Seal For Separating A Utensil From The Carton's Contents" which was filed concurrently herewith on Mar. 4, 1999 under express mailing label no. EL251623212US and which is incorporated herein by reference, can be used to seal the opening in order to separate the product stored in the container from the environment. The seal can be attached to the container about a portion of the outer surface of each of the side panels. The seal can be formed from a polymer, such as linear low density polyethylene (LLDPE). The seal can be attached using an adhesive.

Figure 5:
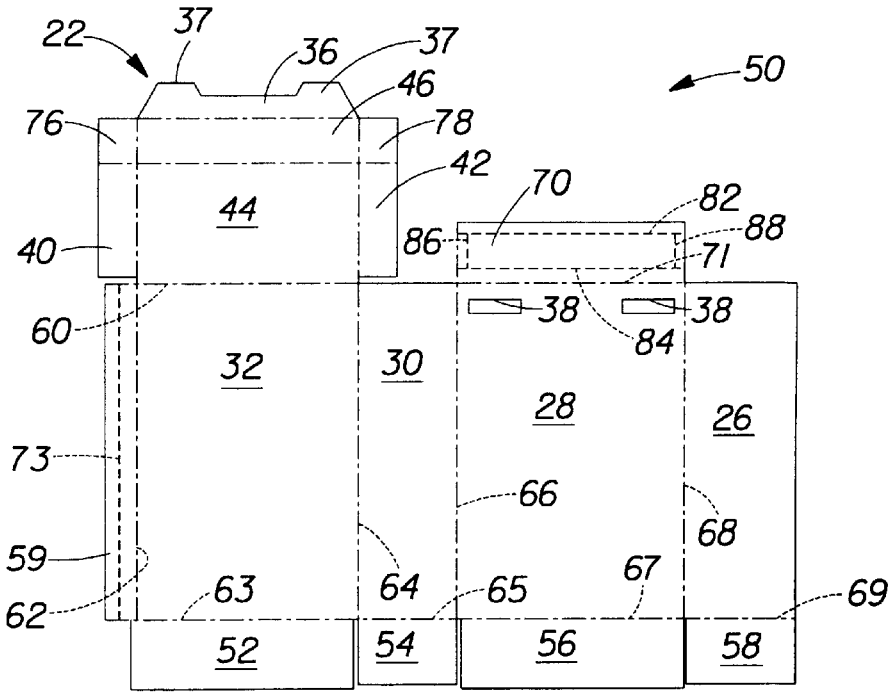
FIG. 5 is a top plan view of a preferred blank suitable for making the package of FIG. 3.

The package 20 can be formed from the blank 50 illustrated in FIG. 5. The blank 50 has a section corresponding to each of the lid flaps 40, 42, 44 and 46 and each of the side panels 26, 28, 30 and 32, as shown. For purposes of discussion, it is the interior surfaces of the flaps and panels of the blank 50 which are visible in FIG. 5. The base 24 of the package 20 is preferably formed from base flaps 52, 54, 56 and 58. The blank 50 also includes a glue flap 59 disposed along an edge of the side panel 32. The flaps and panels of the blank 50 are integrally interconnected with each other by score lines 60, 62, 63, 64, 65, 66, 67, 68, and 69. The score lines are cut deep enough to facilitate bending of the various flaps and panels about their respective score lines without fracture or separation of the flaps and panels from their neighboring flap or panel.

In accordance with another aspect of the present invention, the blank 50 includes a slot cover 70 interconnected with the side panel 28 at the score line 71. Most preferably, the slot cover 70 is integrally formed with the side panel 28 such that the slot cover 70 and the side panel 28 are formed as a single piece. As shown in FIG. 5, each of the slots 38 extends through the side panel 28 so that there is sufficient surface available within slot for locking engagement with the extensions 37 when the lid 22 is in the closed position. The purpose of the slot cover 70 is to shield the slots 38 from the interior of the container and accommodate a slot which extends completely through the side panel 28. While the slot cover 70 is illustrated as single structure, each slot 38 can be provided with a separate slot cover 70 and/or the slot cover 70 can be interconnected with the side panel 28 (or another flap or panel) in other manners (e.g., attached below the slots 38 rather than above) so long as the slot cover 70 shields the slots 38 from the product stored in the interior of the container.

Figure 6:
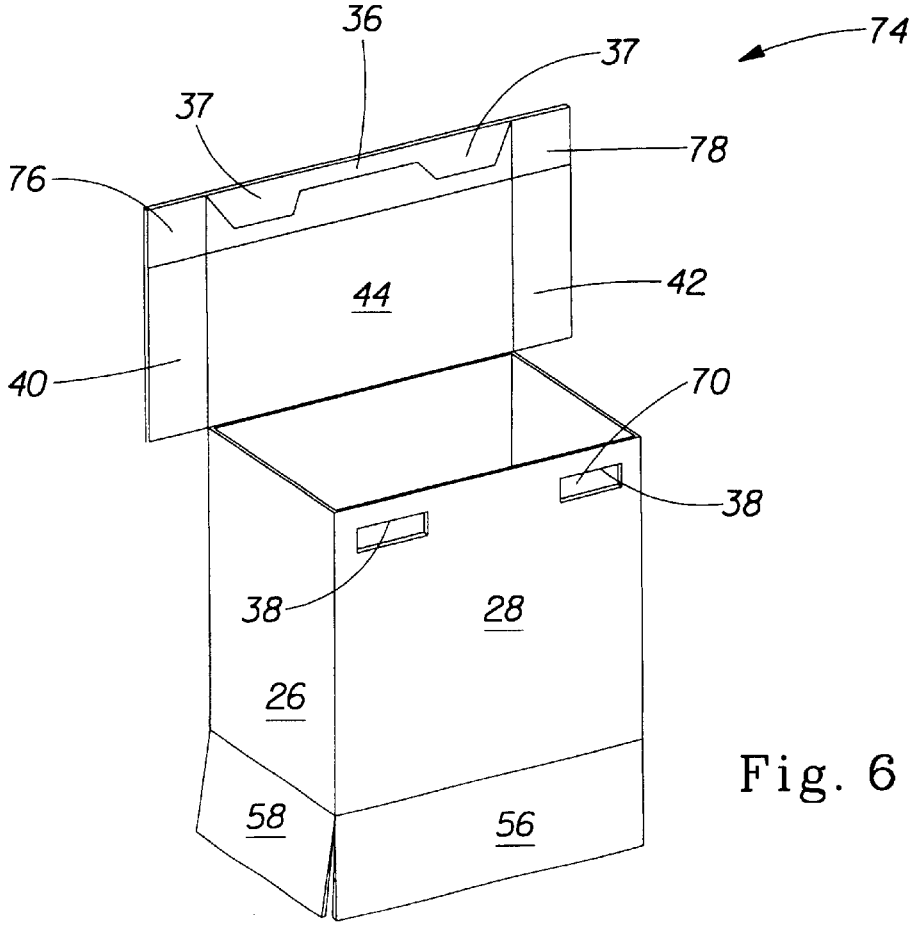
FIG. 6 is a perspective view of the blank of FIG. 5 after initial folding.

To assemble the package 20 from the blank 50, the blank 50 of FIG. 5 is first folded and glued to form the sleeve 74 shown in FIG. 6. In forming the sleeve 74, the glue flap 59 is folded about 90 degrees about the score line 62. Glue is applied to glue flap 59 at the glue line 73 and the blank 50 is folded about the score lines 64, 66 and 68 so that the side panel 30 is disposed adjacent the glue flap 59 such that it can be attached to the glue flap 59 with the adhesive, thereby forming the sleeve 74. The base 24 is formed from the base sections 52, 54, 56 and 58 by interconnecting these sections using an adhesive. Similarly, the lid 22 is formed by adhesively interconnecting the lid flaps 40, 42, and 46 with the interconnecting lid flaps 76 and 78. As will be appreciated, other blanks can be used to form the package 20 without departing from the spirit and scope of the present invention. For example, the lid 22 can be provided as a separate structure apart from the blank 50. In addition, the size and shape of the blank 50 can be varied and the order of folding and gluing the various panels and flaps can also be changed.

During formation of the sleeve 74, the slot cover 70 is preferably folded about 180 degrees about the score line 71, as best seen in FIG. 7. The slot cover 70 is attached to itself after folding by an adhesive at an upper adhesive line 82 after folding about the score line 71. The slot cover 70 is also preferably attached to the side panel 28 by an adhesive along a lower adhesive line 84. Because the upper and lower adhesive lines are disposed above and below the slot 38, respectively, the combination of the slot cover 70 and the adhesive lines effectively seals the slots 38 from the product stored within the package 20, thereby reducing the risk of spillage of the product due accumulation about the extensions 37 when the package 20 is first opened, as well as during subsequent openings. The slot cover 70 is preferably sized so that it is slightly larger than the slots 38 so as to accommodate the upper and lower glue lines 82 and 84. While the slot cover 70 is illustrated as a single piece extending across the length of the side panel 28 (see, e.g., FIG. 3), it is understood that separate slot covers 70 can be provided for each slot 38 of the side panel 28. Additional glue lines 86 and 88 can also be provided transverse to the glue lines 82 and 84 (FIG. 5) so that the adhesive is distributed around the slots thereby completely separating the slots 38 from the product 34 stored in the container 21.

As previously discussed, the tab 36 preferably includes one or more extensions 37 which engage the slots 38, as shown in FIG. 7. The extensions 37 preferably form an acute angle θ with the front lid flap 46, which facilitates the locking function of the extensions 37. More preferably, the angle θ is between about 1 degree and about 70 degrees, and, more preferably, the angle θ is between about 5 degrees and about 30 degrees. The tab 36 and the extensions 37 preferably have sufficient resiliency (i.e., springback) to retain their shape and function after repeated lid opening and closing cycles. This resiliency also assists in the extensions 37 providing an audible click-like sound when engaging the slots 38 to provide confirmation of engagement therewith. The thickness of the tab 36 and the extensions 37 along or in combination with the use of score marks or partial slits at the point where the tab 36 interconnects with front lid flap 46 can be varied to provide the tab and extensions with the appropriate amount of resiliency. The length of the extensions 37 should be at least equal to the thickness of the side panel 28 so that the extensions 37 can fully engage the slots 38.

Figure 8:
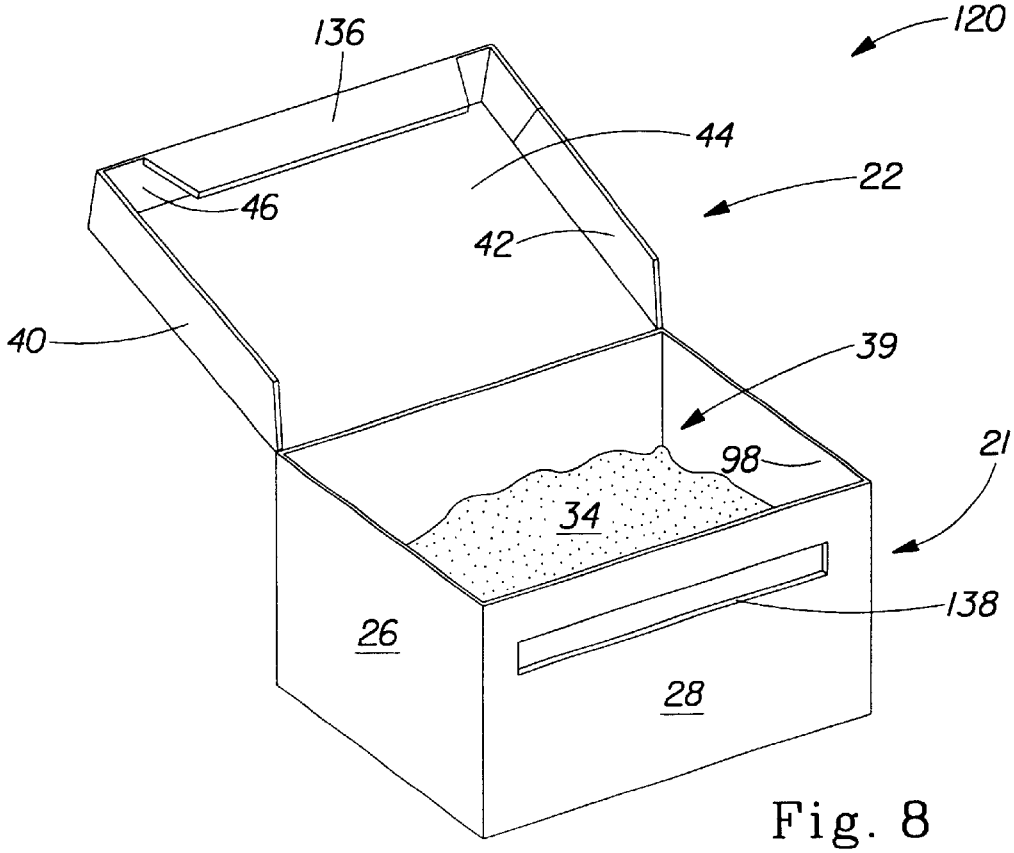
FIG. 8 is a perspective view of another preferred package made in accordance with the present invention, wherein the package has a single slot.

While the package 20 is illustrated as having two slots 38 and two mating extensions 37, it will be appreciated that the package 20 can be provided with other slot and mating extension and/or tab configurations. For example, the panel 28 can be provided with a single slot 138 extending the substantially the length of the side panel 28 of the package 120, as shown in FIG. 8. Also, in the case of larger packages (e.g., packages having a weight when filled of 2 or more kilograms), the container 21 can be provided with a container liner 98 as shown for additional strength (the exemplary container liner 98 also being illustrated in FIGS. 9 and 10). The tab 136, which engages the slot, can be provided without the extensions 37 since they are no longer necessary when a long single slot is utilized.

Figure 9:
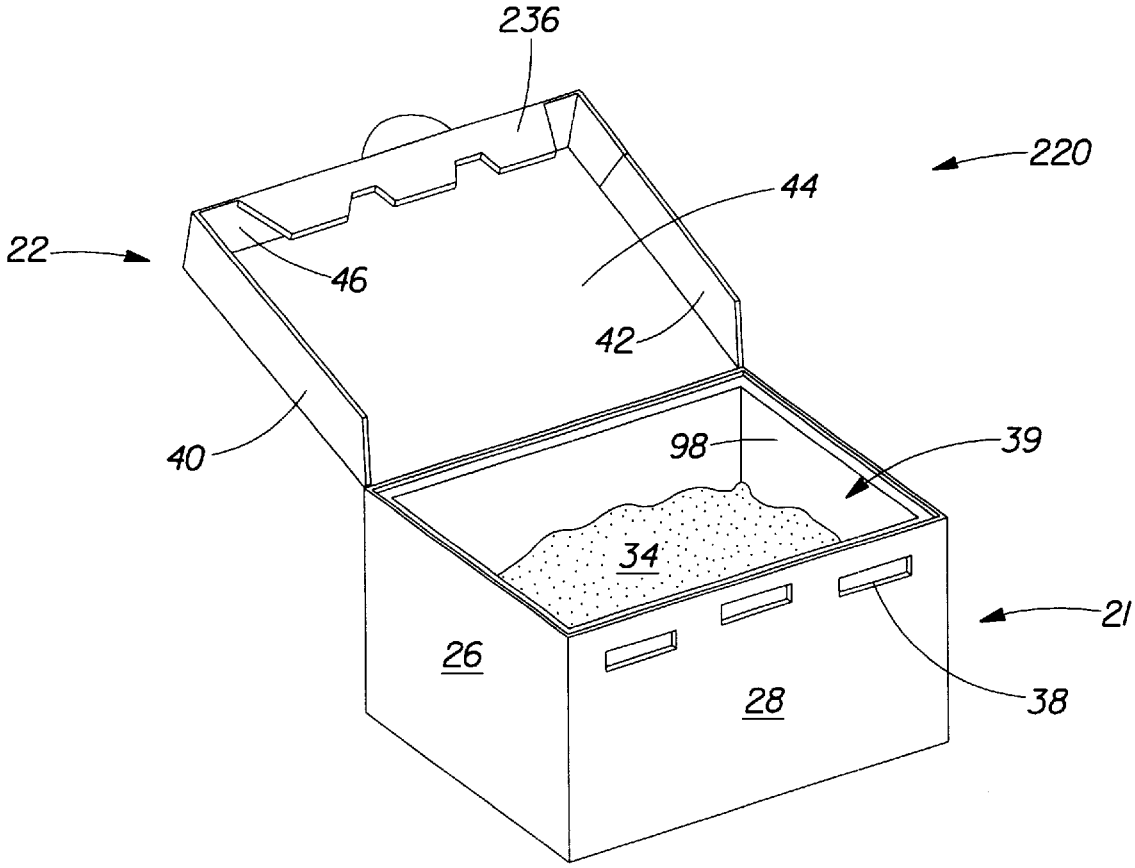
FIG. 9 is a perspective view of yet another preferred package made in accordance with the present invention, wherein the package has a three slots.
Figure 10:
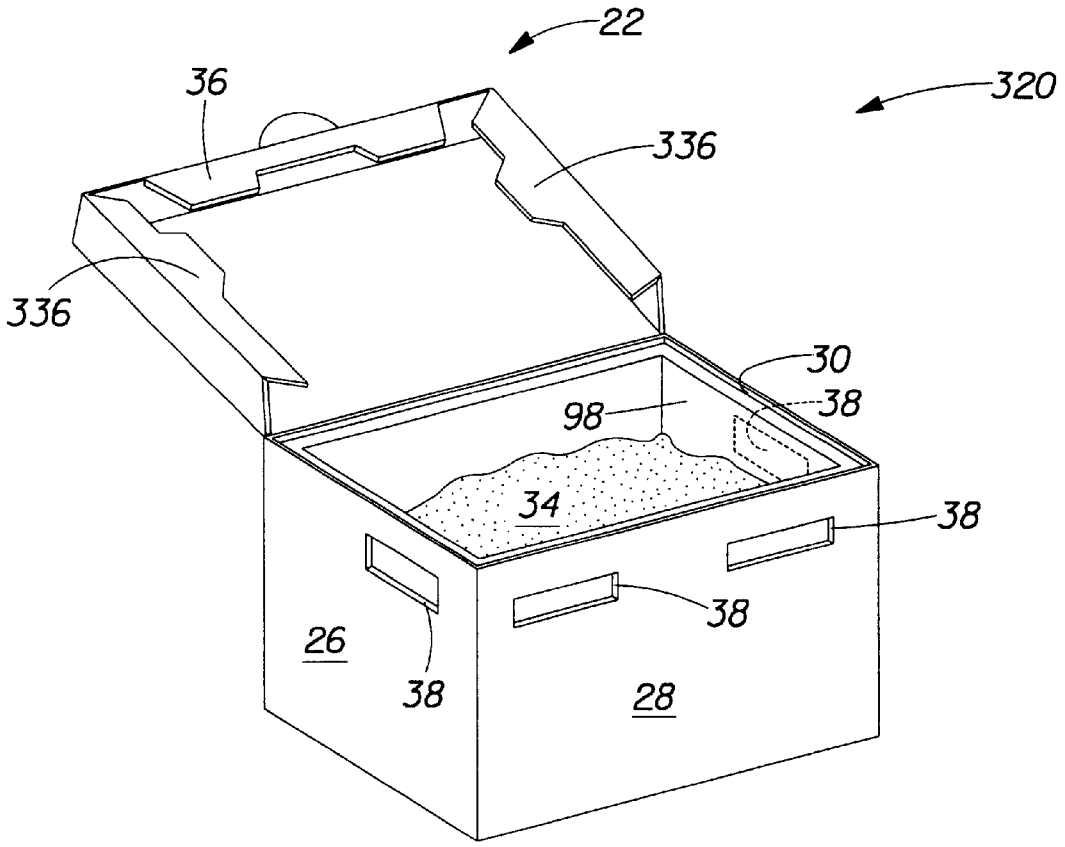
FIG. 10 is a perspective view of still another preferred package made in accordance with the present invention, wherein the package has slots disposed on multiple side panels.
Figure 11:
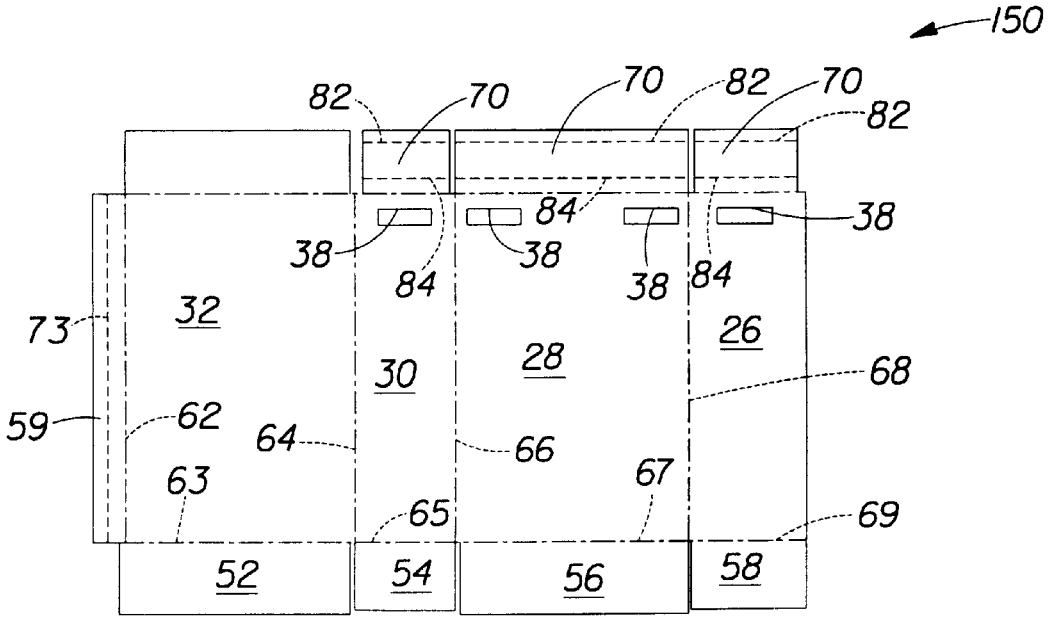
FIG. 11 is a top plan view of an exemplary blank suitable for making the package of FIG. 10.

Alternatively, the panel 28 can be provided with more than two slots, as shown in FIG. 9. The length, width and shape of the slots 38 can be varied, and, where multiple slots are disposed on the same panel, the orientation of the slots relative to one another can also be varied. For instance, the slots can be offset from one another, as shown in FIG. 9. Further, additional slots can be provided on the other side panels (e.g., panels 26 and 30) and in combination with, or in the alternative to, the slots 38 of the side panel 28, as shown in FIG. 10. The lid 22 of the package 320 further comprises additional tabs 336 and extensions for engaging the slots 38 of the side panels 26 and 30. An exemplary blank 150 which can be used to form the package 320 is illustrated in FIG. 11. The blank 150 is similar to the blank 50 but includes additional slot covers 70 which are disposed adjacent to and integrally interconnected with the side panels 26 and 30. These slot covers are used to the cover the slots 38 of the side panels 26 and 30 the same as previously described with respect to the slots 38 of side panel 28. While, the blank 150 is illustrated without the lid 22 attached, it is contemplated that the slot cover 70 attached to the side panel 30 could be arranged differently to accommodate integral attachment of the lid 22 to the blank 150.

Providing additional extensions, slots and slot covers further increases the ability of the lid 22 to resist opening forces during use, such as when the package is knocked over, while still providing a sift-resistant package. In addition, placement of the extensions 37 toward the corners of a lid 22 (i.e., near the intersection of the front lid flap 46 with the side lid flaps 40 and 42) improves the lid/container locking effectiveness. The use of slots and extensions on multiple side panels also increases the locking effectiveness of the present invention.

Figure 12:
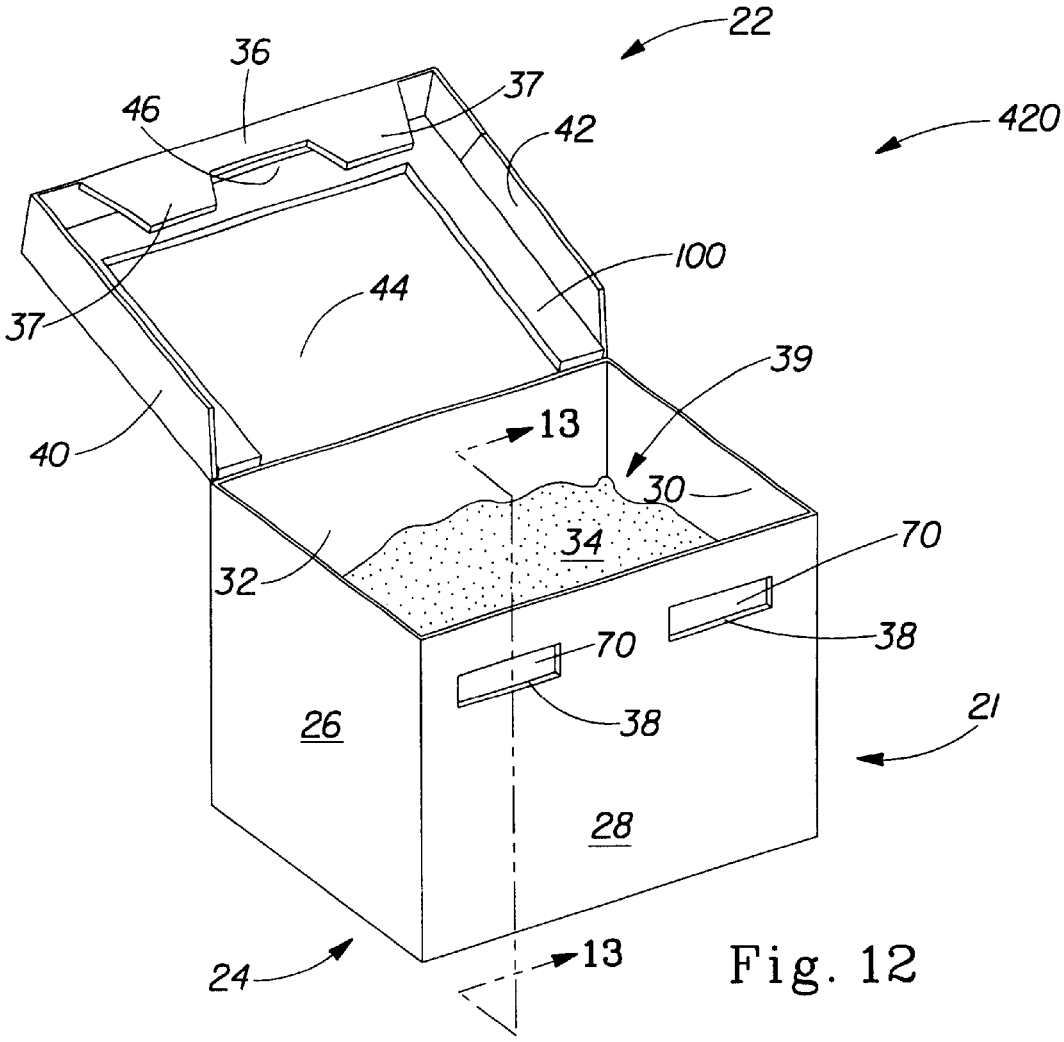
FIG. 12 is a perspective view of still a further preferred package made in accordance with the present invention, wherein the lid comprises a gasket.
Figure 13:
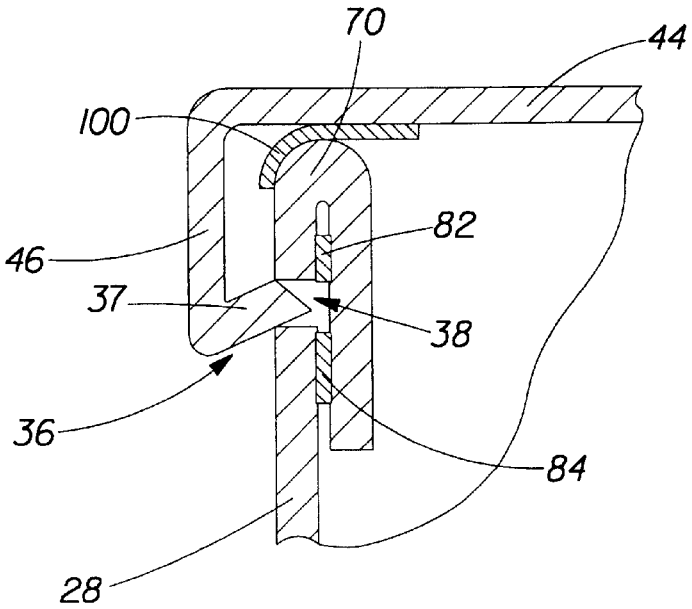
FIG. 13 is an enlarged partial cross-sectional side view of the package of FIG. 12, taken along line 13—13 thereof and with the lid in the closed position.

Referring to FIGS. 12 and 13, the sealing effectiveness of the lid 22 can be further enhanced by attachment of a flexible gasket 100 (e.g., in the form of a tape or a flexible silicone-like glue) to the top lid flap 44. The gasket 100 is preferably U-shaped and also disposed adjacent to the front and side lid flaps 40, 42 and 46 such that it can engage the tops of the side panels 26 and 30 and the top of the slot cover 70 when the lid is in the closed position. The gasket 100 assists in preventing sifting of the product between slot cover 70 and the top lid flap 44 when the lid 22 is closed.

Figure 14:
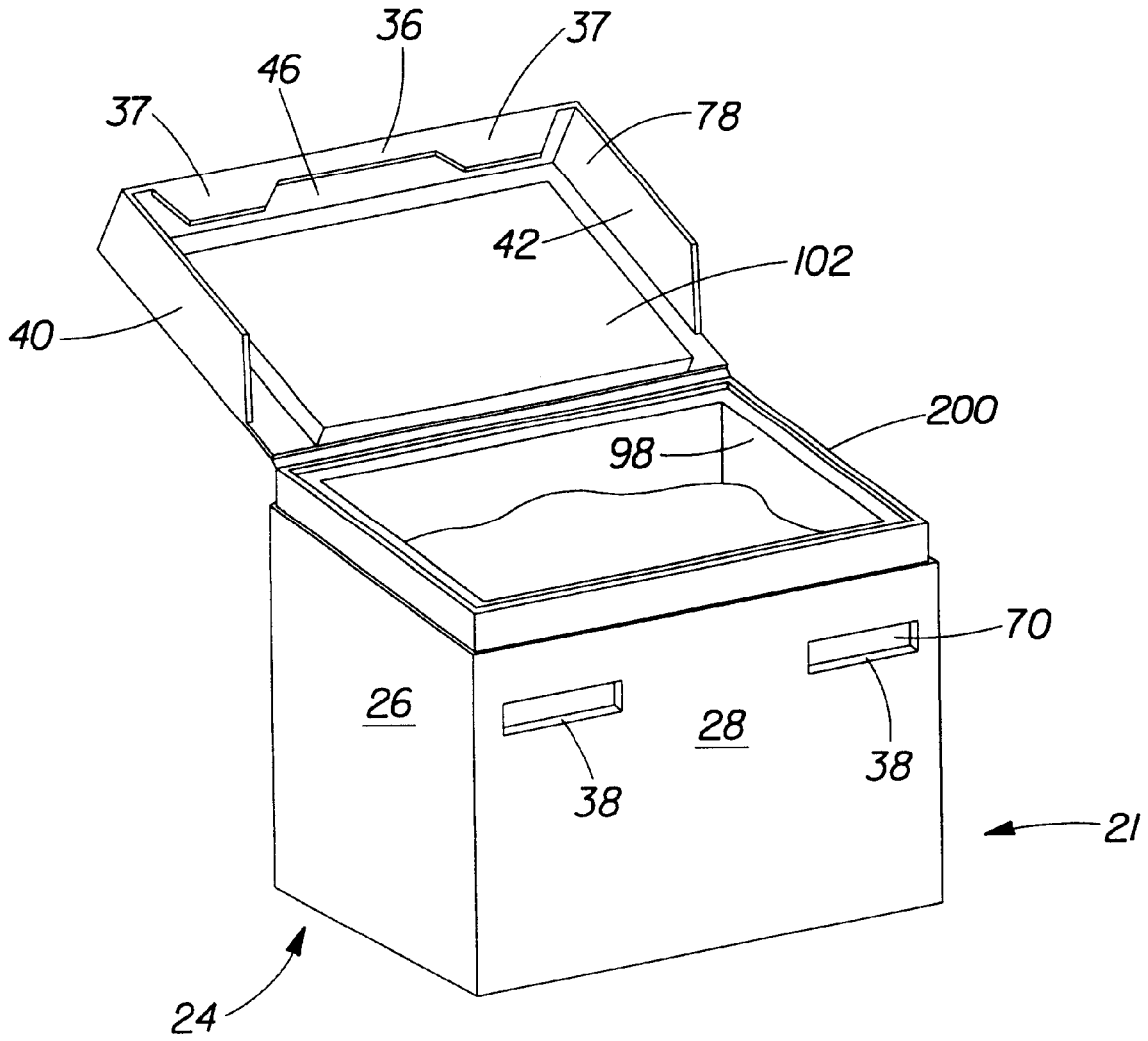
FIG. 14 is a perspective view of yet another preferred package made in accordance with the present invention, wherein the package comprises a gasket about the top perimeter of the container of the package.

Alternatively, a flexible gasket 200 can be placed about or adjacent to the top perimeter the side panels 26, 28 and 30 of a package 420, as shown in FIG. 14. The package 420 also comprises the container liner 98 and a lid liner 102. Each of the liners are preferably attached to their adjacent panels by adhesive and provide additional rigidity to the package 420.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A sift-resistant reclosable package for a granular or powdered product, comprising:

a container for storing the product, said container comprising a first panel having an inner and an outer surface and having at least one slot disposed therethrough, a cover extending over said slot for preventing the sifting of the product through said slot, said cover being attached to the inner surface of said first panel; and a lid hingedly attached to said container, said lid having a downwardly depending flap with an extension attached thereto wherein said flap and said extension are made of a resilient material such that said extension engages said slot when said container is closed by said lid and such that said lid is locked, thereby maintaining said container in a closed position and preventing buildup of the product on the edge of the extension.

2. The sift-resistant reclosable package of claim 1 wherein said cover is attached to said first panel by an upper and a lower adhesive line relative to said slot and wherein said upper and lower adhesive lines are adjacent said slot.

3. The sift-resistant reclosable package of claim 1 wherein said extension forms an acute angle with said flap.

4. The sift-resistant reclosable package of claim 1 wherein said cover is integrally formed with said side panel having said slot and wherein said cover is folded behind said side panel to cover said slot.

5. The package of claim 1, wherein said first panel further comprises a plurality of slots and said lid further comprises a plurality of extensions for engaging said plurality of slots.

6. The package of claim 1, wherein said lid further comprises a U-shaped gasket for sealingly engaging said cover.

7. The package of claim 1, wherein said container further comprises an inner liner disposed within said container for storing the product, said inner liner being disposed adjacent said first panel and said cover.

8. The package of claim 1, wherein said container further comprises a second panel having an inner and an outer surface and having at least one slot disposed therethrough, a cover extending over said slot for preventing the sifting of the product through said slot, said cover being attached to the inner surface of said second panel and wherein said lid further comprises a second downwardly depending flap with an extension attached thereto for engaging the slot of said second panel.

9. The package of claim 3 wherein said acute angle is comprised between about 5° and 7°.

* * * * *